US009441448B2

(12) United States Patent
Frazier

(10) Patent No.: US 9,441,448 B2
(45) Date of Patent: Sep. 13, 2016

(54) DOWN HOLE TOOL HAVING IMPROVED SEGMENTED BACK UP RING

(71) Applicant: W. Lynn Frazier, Corpus Christi, TX (US)

(72) Inventor: W. Lynn Frazier, Corpus Christi, TX (US)

(73) Assignee: MAGNUM OIL TOOLS INTERNATIONAL, LTD, Corpus Christi, TX (US)

( * ) Notice: Subject to any disclaimer, the term of this patent is extended or adjusted under 35 U.S.C. 154(b) by 438 days.

(21) Appl. No.: 13/999,329

(22) Filed: Feb. 10, 2014

(65) Prior Publication Data

US 2014/0224476 A1 Aug. 14, 2014

Related U.S. Application Data

(60) Provisional application No. 61/850,425, filed on Feb. 14, 2013.

(51) Int. Cl.
*E21B 33/129* (2006.01)
*E21B 33/12* (2006.01)

(52) U.S. Cl.
CPC ..... *E21B 33/1216* (2013.01)

(58) Field of Classification Search
CPC ..... E21B 33/1204; E21B 33/129; E21B 33/1216; E21B 33/1293; E21B 33/134; E21B 33/1208
See application file for complete search history.

(56) References Cited

U.S. PATENT DOCUMENTS 2,204,659 A * 6/1940 Burt ..... E21B 33/129 166/217
2,653,666 A * 9/1953 Baker ..... E21B 23/065 166/117
3,374,840 A * 3/1968 Current ..... E21B 33/1293 166/134
3,385,679 A * 5/1968 Current ..... E21B 33/1216 428/579
3,554,280 A 1/1971 Tucker
3,687,196 A * 8/1972 Mullins ..... E21B 23/01 166/217
4,397,351 A 8/1983 Harris
4,730,835 A 3/1988 Wilcox
5,024,270 A 6/1991 Bostick
5,224,540 A * 7/1993 Streich ..... E21B 29/00 166/118
5,540,279 A 7/1996 Branch
5,819,846 A * 10/1998 Bolt, Jr. ..... E21B 33/134 166/123
5,984,007 A * 11/1999 Yuan ..... E21B 33/1204 166/118
6,167,963 B1 * 1/2001 McMahan ..... E21B 33/1204 166/118
6,695,051 B2 * 2/2004 Smith ..... E21B 33/1216 166/134

(Continued)

*Primary Examiner* — Daniel P Stephenson
(74) *Attorney, Agent, or Firm* — G. Turner Moller

(57) ABSTRACT

A down hole tool or plug includes a segmented back up ring acting to minimize extrusion of a seal in an axial direction thereby promoting radial expansion of the seal into engagement with the internal diameter of a casing string. The segments of the ring are joined to a ring body having a passage thereby by a junction having, as its outer dimension, the outside diameter of the tool and an inside dimension provided by a groove opening into the passage.

14 Claims, 2 Drawing Sheets

(56) References Cited

U.S. PATENT DOCUMENTS 6,769,491 B2 8/2004 Zimmerman
7,578,353 B2 8/2009 Cook
7,789,137 B2 * 9/2010 Turley ..... E21B 33/1208 166/118
8,066,065 B2 11/2011 Buckner
8,336,616 B1 12/2012 McClinton
8,496,052 B2 * 7/2013 Frazier ..... E21B 33/134 166/124
8,839,855 B1 * 9/2014 McClinton ..... E21B 33/1292 166/135
2008/0073074 A1 * 3/2008 Frazier ..... E21B 33/1294 166/138
2010/0276159 A1 * 11/2010 Mailand ..... E21B 33/134 166/382
2011/0277987 A1 * 11/2011 Frazier ..... E21B 33/134 166/181
2014/0224476 A1 * 8/2014 Frazier ..... E21B 33/1216 166/135

* cited by examiner

DOWN HOLE TOOL HAVING IMPROVED SEGMENTED BACK UP RING

This invention relates to an improved tool or plug for use in hydrocarbon wells having a modified segmented back up ring to restrain deformation of a seal.

BACKGROUND OF THE INVENTION

There are many well tools that incorporate a sealing member that is deformed into sealing engagement with a casing string. Typically such tools are called plugs, one species of plugs being packers. Many plugs are designed to be soluble, meltable or drillable, i.e. they incorporate a modest amount of materials that not easily drillable and are typically mostly made of composites, polymers, aluminum, brass and the like which are easily removed from a well in any of a variety of ways.

These type tools usually incorporate slips that grip the interior of a casing string, an expansion device or devices to expand the slips into gripping engagement with the casing string and a deformable or resilient seal member that is compressed during actuation of the plug so it expands more-or-less radially into sealing engagement with the casing string. An element often used in such devices is known as a back up ring, a support ring, a back up shoe, a gage ring or the like, the purpose of which is to restrain axial expansion of the deformable seal so it is directed radially against the casing string. In other words, these devices are anti-extrusion devices which minimize or prevent extrusion of the malleable seal axially along the tool and thereby minimize or prevent leakage past the seal.

Disclosures of some interest relative to this invention are found in U.S. Pat. Nos. 3,554,280; 4,397,351; 4,730,835; 5,024,270; 5,540,279; 6,739,491; 7,578,353; 8,066,065 and 8,336,616.

SUMMARY OF THE INVENTION

As disclosed herein, a plug has a collapsed or running in position so it an be run in a well, such as a hydrocarbon well, and an expanded or operative position where a deformable seal is pressed against the inside of a casing string or well bore in the case of an open hole packer. Such plugs include the deformable seal, slips that anchor the plug in a desired position, some way allowing manipulation of the tool so it can be expanded from the running in position to the operative position and a back up ring to restrain deformation of the seal so it efficiently expands against the casing string.

Many current generation plugs are used during completion of wells and are designed to be readily drilled up in order to minimize completion costs. Current generation back up rings are made of composite material and are segmented so that when the plug is set or expanded, the segments flare out against the casing string in much the same manner as flower petals opening and thereby prevent extrusion of the deformable seal axially. This directs the deformable seal radially toward the casing string. It has been learned that current model segmented back up rings sometimes fail in laboratory tests of extended reach plugs such as shown in U.S. application Ser. No. 13/737,223, filed Nov. 8, 2011, the disclosure of which is incorporated herein by reference. Although such back up rings often fail during laboratory tests, no field failures have yet been seen which is not surprising because down hole failures are unusual and because the cause is almost never known.

Extensive tests are run by Magnum Oil Tools, Ltd. on many different types of plugs. On extended reach plugs where the tool, in its running in condition, is relatively small compared to its expanded condition and necessarily undergoes considerable expansion, it is common for the petals of back up rings to fracture and detach from the main part of the ring during testing.

The failure rate of back up rings has, by use of the construction disclosed herein, has so far fallen to zero. This is accomplished, as disclosed hereinafter, by moving the connection between the segment or petal and the ring body toward the exterior of the back up ring.

It is an object of this invention to provide an improved segmented back up ring and a plug incorporating the same.

Another object of this invention is to provide an improved segmented back up ring that allows flaring of the segments without fracturing the segment from the body to which it is attached.

These and other objects and advantage of this invention will become more fully apparent as this description proceeds, reference being made to the accompanying drawings.

DETAILED DESCRIPTION OF THE INVENTION

As used herein, upper refers to that end of the tool that is nearest the earth's surface, which in a vertical well would be the upper end but which in a horizontal well might be no more elevated than the opposite end. Similarly, lower refers to that end of the tool that is furthest from earth's surface. Although these terms may be thought to be somewhat misleading, they are more normal than the more correct terms proximal and distal ends.

Figure 1:
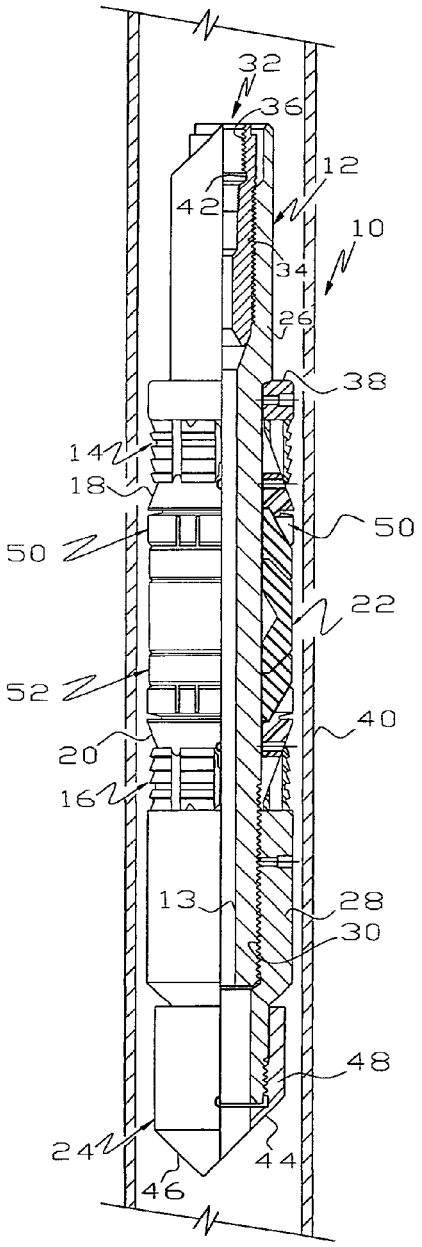
Fig.1 (Prior Art)
FIG. 1 is a partial vertical cross-sectional view of a plug equipped with a segmented back up ring.

Referring to FIG. 1, a plug 10 may comprise, as major components, a body or mandrel 12 having a passage 13 therethrough, one or more sets of slips 14, 16, one or more wedge sections 18, 20, a rubber or packing element 22 and an anti-rotation device or mule shoe 24. The body 12 may include an upper section 26 and a lower section 28 connected together in a suitable manner, such as by threads 30. The tool 10 is illustrated as of a type that can be converted between a bridge plug, a flow back plug, a check valve plug or otherwise by installing or removing a component in an insert 32 such as shown in U.S. Pat. No. 8,307,892, the disclosure of which is incorporated herein by reference. The component may be a plug, a valve ball, a soluble ball or the like as shown in U.S. patent application Ser. No. 12/317,497, filed Dec. 23, 2008, the disclosure of which is incorporated herein by reference.

The insert 32 may be attached to the upper body 26 by suitable threads 34 and may include internal threads 36 for connection to a conventional setting tool (not shown) connected to a wire line extending to the surface. The setting tool (not shown) may act in a conventional manner by pushing down on the top of a collar 38 and pulling up on the threads 36. This shears a pin (not shown) and allows the collar 38 to move downward relative to the slips 14, 16 thereby expanding the slips 14, 16 into gripping engagement with the casing 40.

The slips 14, 16, the wedges 18, 20 and the packing element 22 may be of a conventional type as shown in U.S. patent application Ser. No. 12/317,497, filed Dec. 23, 2008 so the tool is set in a conventional manner. During setting of the tool 10, the slips 14, 16 ride along the wedges 18, 20 to expand the slips 14, 16 and fracture them into a number of segments in gripping engagement with the interior of a casing string 40 which may be cemented in a well bore (not shown). At the end of the setting of the tool 10, the insert 32 fails or breaks at a neck 42 thereby detaching the threads 36 and the setting tool (not shown) so the setting tool and wire line may be removed from the well.

The anti-rotation device 24 acts to minimize or prevent rotation of the tool when it is being drilled up by interacting with a subjacent tool. This may be accomplished in a number of ways, one of which is to provide angled faces 44, 46 on the bottom of a body 48 of the anti-rotation device 24.

Figure 2:
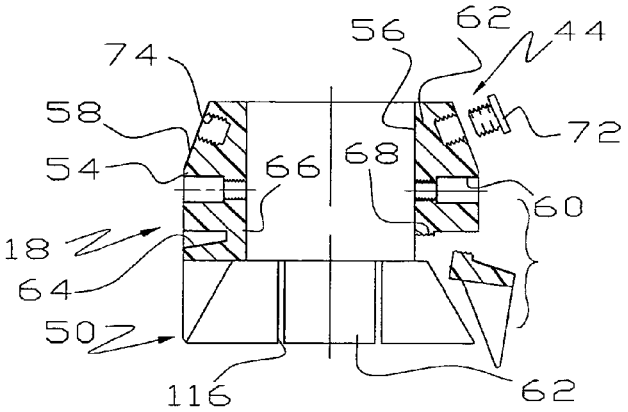
Fig.2 (Prior Art)
FIG. 2 is a cross-sectional view of a conventional segmented back up ring.

The plug 10 may also include one or more back up rings 50, 52 which may be part of the wedges 18, 20 or may be separate members. In addition, the back up rings 50, 52 may abut the packing element 22 or may abut an intermediate annular support as discussed hereinafter which may be a drillable material, soluble material or meltable material such as a drillable metal, polymer or composite. As shown in FIG. 2, a conventional wedge or expander 18 may be of conventional shape and can comprise a body 54 having a central passage 56, a tapered exterior or conical section 58 and one or more set screw passages 60 for securing the lowermost wedge 20 to the body 12. Pulling up on the insert 32 causes the lowermost wedge 20 to rise relative to the uppermost wedge 18 thereby setting the slips 14, 16 and expanding the seal 22.

The back up rings 50, 52 may be part of the bottom of the wedges 18, 20 and may include a series of tapered segments 62 extending circumferentially around the passage 84. The segments 62 can act like flower petals and flare out against the casing 40 during setting of the plug 10 and thereby constrain movement of the seal 22 into generally radial movement into sealing engagement with the casing 40. In drillable plugs, the back up rings 50, 52 may preferably be of a conventional composite material or polymer. Current composite or polymer materials are rigid at room temperature but become somewhat pliable or flexible at typical temperatures found in hydrocarbon wells. To promote the flexibility of the segments 62, an exterior notch 64 has been provided. Those skilled in the art will recognize the plug 10 as being of a type commercially available from Magnum Oil Tools International of Corpus Christi, Tex.

Some fraction of laboratory tests with the conventional back up rings 50, 52 in plugs similar to the plug 10 have experienced failure of the segments 62, i.e. a fracture or complete break sometimes develops in the joint 66 between the end of the notch 64 and the central passage 56 as represented by the jagged line 68. When a segment 62 detaches from the body 54, this allows the seal 22 to expand axially into the gap left by the detached segment 62 thereby reducing the ability of the seal 22 to move radially into sealing engagement with the casing 40 thereby reducing the ability of the seal 22 to seal against the casing 40. No field failures have yet been reported even though several thousand plugs with the design of FIG. 2 have been run and set in hydrocarbon wells, have sustained fracing pressures when the wells were fraced and have then been drilled up. The absence of reported field failures may be simple good luck, it may be that a small seal leak is not consequential in light of the high volume pumped during frac jobs or it may be that frac sand bridges off the plug, even if it is leaking. In any event, it is desirable to provide a back up ring that does not fail by fracturing at the joint between the segment 62 and the body 54.

Figure 3:
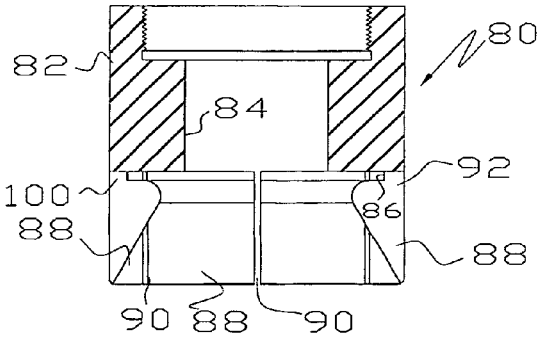
FIG. 3 is a cross-sectional view of an improved segmented back up ring.
Figure 4:
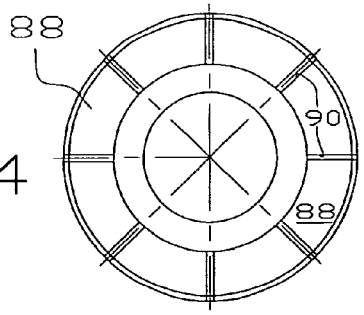
FIG. 4 is an end view of the segmented back up ring of FIG. 3.

To this end, the segmented back up ring 80 is provided. The back up ring 80 may be integral with the wedges 18, 20 or may be separate, as illustrated in FIG. 3, from an expander dome (not shown) which may be affixed to the back up ring 80 by suitable threads or other means. Integral and separate segmented back up rings are illustrated in U.S. application Ser. No. 13/373,223, filed Nov. 8, 2011, which is incorporated herein by reference. The back up ring 80 may comprise a body 82 having a cone (not shown) on the upper end or an integral cone which acts to fracture or expand the slips 14, 16 in a conventional manner. A passage 84 through the back up ring 80 allows the back up ring 80 to be received on the body 12. Instead of the groove 64 on the outside of the back up ring, a groove 86 on the inside of the back up ring 80 opens into the passage 84 and imparts some flexibility to the petals or segments 88 at reservoir temperature. As in the prior art, the segments 88 are separated by a gap or kerf 90 which may be formed in any suitable manner, as by cutting with a saw.

The back up ring 80 accordingly provides a connection or joint 92 between the segments 88 and the body 82. The outside of the junction 92 may be on the outside diameter of the body 82 or adjacent the outside diameter of the body 82 or, in any event, is closer to the outside diameter than to the inside diameter. The back up ring 80 may be made of a soluble, meltable or drillable material such as aluminum, brass, a composite material or polymer either by machining, injection molding or otherwise. The kerfs 90 separating the segments 88 may preferably extend through the junction 92 and separate it into segments. Thus, kerfs in the junction 92 may be coplanar with kerfs through the segments 88.

Figure 5:
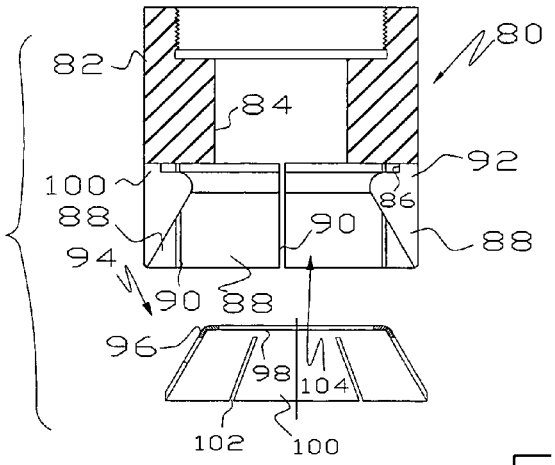
FIG. 5 is an exploded view of an improved segmented back up ring, as in FIG. 3, in conjunction with a separate additional annular support.

As suggested in FIG. 1, the back up ring 80 may abut the packing element 22 or may abut an intermediate annular support or second back up ring 94 as shown in FIG. 5 which is in load transferring relation between the back up ring 80 and the packing element or seal 22. The annular support 94 may be a soluble, meltable or drillable metal, plastic or composite material. The annular support 94 may comprise a rim or body 96 having a passage 98 therethrough from which depend segments 100 resembling the segments 88 of the back up ring 80. The segments 100 may be separated by kerfs or slots 102 and may flare outwardly to nest in a cavity 104 in one end of the back up ring 80. It will be seen that the back up ring 80 is in force transmitting relation with the seal 22, either in direct contact as in the embodiment of FIG. 3 or in indirect contact through the annular support 94 as in the embodiment of FIG. 5.

Lab tests of plugs incorporating the improved back up ring 80 show that the connection or joint 92 does not fracture or fail under conditions where the segments 62 of the prior art back up ring 50 are prone to fail. There appear to be several reasons. One reason may be the junction 92 between the segments 88 and the body 82, being on or adjacent the outside diameter of the body 82, is necessarily longer and therefore has more material than a comparably thick junction on the inside diameter, as in FIG. 2.

Second, it may be that the geometry of the segments 88 is more favorable than the geometry of the segments 62, i.e. the junctions 66, 92 act analogously to a pivot about which the petals 62, 88 rotate. Because the junction 66 is further from the inside wall of the casing 40, the base of the petals 62 have to undergo more movement than the base of the petals 88 in order for the tips of the petal to reach the I.D. of the casing 40. This is shown by a comparison of FIGS. 6 and 7.

Third, the thickness of the junction 92 may be thicker than in the prior art for reasons which are not immediately apparent. It may be that the segments 88 have to move so much less, as discussed above, that a thicker junction 92 can still allow sufficient flexibility. One would think that the junction 66 of the prior art might be thickened but the depth of the notch 64 is needed to provide the necessary flexibility of the segments 62.

Figure 6:
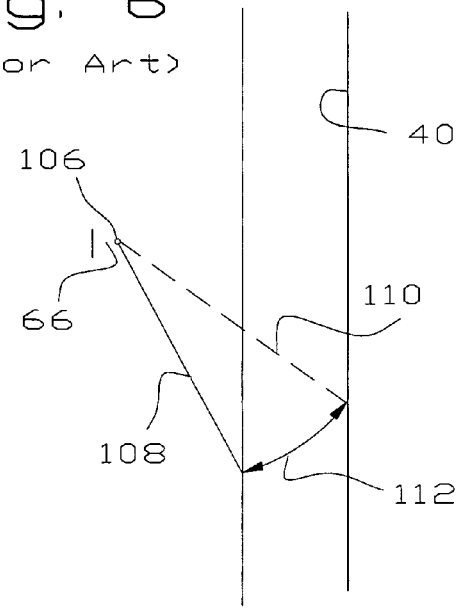
Fig. 6 (Prior Art)
FIG. 6 is a schematic view of the relationship between a segment of a conventional back up ring and a casing string which it abuts in an expanded condition of the plug.

In FIG. 6, a conventional segment is connected to the body of the back up ring at a junction 66 and basically pivots about a point 106 from a solid line position 108 to a dashed line position 110 to engage the inside of the casing string 40 upon expansion of the plug 10. The solid line position 108 represents the centerline of the unstressed segment 62 and the dashed line position 110 represents the centerline of the stressed segment 62 when it abuts the casing 40. The angle 112 is accordingly defined by the length of the solid line 108 and the distance between the pivot point 106 and the inside of the casing string 40.

Figure 7:
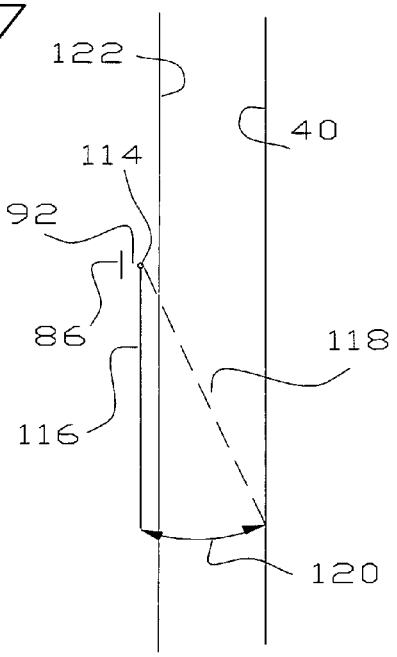
FIG. 7 is a view similar to FIG. 6 illustrating the relationship between a segment of an improved back up ring and the casing string.

In FIG. 7, a segment of the improved back up ring 80 is connected to the body at a junction 92 and basically pivots about a point 114 from a solid line position 116 to a dashed line position 118 to engage the inside of the casing sting 40 upon expansion of the plug 10. The solid line 116 represents the centerline of the unstressed segment 88 and the dashed line represents the centerline of the stressed segment 88 when it abuts the casing 40. The angle 120 is accordingly defined by the length of the solid line 116 and the distance between the pivot point 114 and the inside of the casing string 40. The angle 120 will be found to be smaller than the angle 112 and is necessarily smaller than the angle 112. The same idea can be visualized by extending one's arm slightly away from one's body and asking: is the angle between the arm and the side of the body smaller than the angle between the arm and the centerline of the thigh.

It will be seen that a preferred location of the pivot point 114 may be as close as possible to the outer diameter of the tool 10 represented by the line 120 in FIG. 7 but some advantages accrue as the pivot point is moved from the inner diameter of the tool toward the outer diameter. In other words, a preferred location of the outside of the junction 92 may be the outer diameter of the tool 10.

Although this invention has been disclosed and described in one of its preferred forms with a certain degree of particularity, it is understood that the present disclosure of the preferred form is only by way of example and that numerous changes in the details of operation and in the combination and arrangement of parts may be resorted to without departing from the spirit and scope of the invention.

I claim:

1. A down hole plug for a well comprising at least one set of slips, a malleable sealing element, an expander for expanding the slips and sealing element into engagement with an interior of a pipe string and a back up ring comprising a body having a passage therethrough and a series of spaced apart circumferentially arranged segments adjacent and facing one end of the sealing element, the segments being connected to the body by a junction having an outer side adjacent an external dimension of the body and an inner side provided by a groove opening into the passage.

2. The down hole plug of claim 1 wherein the outer side of the junction is the external diameter of the body.

3. The down hole plug of claim 1 wherein the back up ring is of a drillable material.

4. The down hole plug of claim 1 wherein the segments are tapered having a wide end joined to the body and a narrow end extending toward the malleable sealing element.

5. The down hole plug of claim 1 wherein the segments are separated by first gaps and the junction comprises a series of segments of an annular ring separated by second gaps coplanar with the first gaps.

6. The down hole plug of claim 1 further comprising a second segmented back up ring comprising a second body having a second passage therethrough and a series of second segments adjacent and facing an opposite end of the sealing element, the second segments being connected to the second body by a junction having an outer side adjacent an external diameter of the body and an inner side provided by a groove opening into the second passage.

7. The down hole plug of claim 1 wherein the outside of the back up ring is cylindrical and the external dimension is an external diameter.

8. The down hole plug of claim 1 further comprising an annular support between the back up ring and the malleable element.

9. The down hole plug of claim 8 wherein the annular support comprises a series of separate circumferentially spaced segments.

10. A down hole plug for a well comprising at least one set of slips, a malleable sealing element, an expander for expanding the slips and sealing element into engagement with an interior of a pipe string and a back up ring comprising a body having a passage therethrough and a series of spaced apart segments circumferentially arranged around the passage, the segments being adjacent and facing one end of the sealing element, the segments being connected to the body by a junction having an outer side adjacent an external dimension of the body and an inner side provided by a groove opening into the passage.

11. The down hole plug of claim 10 wherein the outer side of the junction is an external diameter of the body.

12. The down hole plug of claim 10 wherein the segments are tapered having a wide end joined to the body and a narrow end extending toward the malleable sealing element.

13. The down hole plug of claim 10 wherein the segments are separated by first gaps and the junction comprises a series of segments of an annular ring separated by second gaps coplanar with the first gaps.

14. The down hole plug of claim 10 further comprising a second segmented back up ring comprising a second body having a second passage therethrough and a series of second segments adjacent and facing an opposite end of the sealing element, the second segments being connected to the second body by a junction having an outer side adjacent an external diameter of the body and an inner side provided by a groove opening into the second passage.

* * * * *